United States Patent [19]

Marks, deceased et al.

[11] Patent Number: 4,658,694

[45] Date of Patent: Apr. 21, 1987

[54] PERCUSSION NOISEMAKER

[76] Inventors: Lawrence Marks, deceased, late of Chicago, Ill.; by Esther Marks, administrator, 6619 N. California Ave., Chicago, Ill. 60645

[21] Appl. No.: 769,454

[22] Filed: Aug. 26, 1985

[51] Int. Cl.[4] ..... G10D 13/06

[52] U.S. Cl. ..... 84/402; 446/422

[58] Field of Search ..... 84/402, 422; 446/418, 446/421, 422

[56] References Cited

U.S. PATENT DOCUMENTS

| | | | |
|---|---|---|---|
| 2,616,218 | 11/1952 | Brown | 84/402 |
| 2,848,839 | 8/1958 | Haines | 446/418 |
| 4,187,635 | 2/1980 | Deissler | 84/402 X |
| 4,266,459 | 5/1981 | Seregely | 84/402 |

*Primary Examiner*—Lawrence R. Franklin

*Attorney, Agent, or Firm*—Kinzer, Plyer, Dorn & McEachran

[57] ABSTRACT

A percussion noisemaker capable of two distinctive noise effects comprises a pair of thin, flat, elongated wooden clapper arms having handle ends mounted together so that the two arms form a narrow V with flat surfaces of the arms facing each other; a fulcrum member is interposed between the arms near their handle ends. A pair of wood clapper knobs are mounted opposite each other on the inside of the V at the ends of the clapper arms remote from their handle ends, and two funnel shaped molded plastic sounding members are mounted on the outside of the V in alignment with the clapper knobs.

9 Claims, 3 Drawing Figures

PERCUSSION NOISEMAKER

BACKGROUND OF THE INVENTION

A variety of plural-arm clapper-type noisemakers have been proposed; some have been referred to as musical instruments, others as toys or rattles. Devices of this general kind have also been employed as animal training devices. All constitute percussion noisemakers of one sort or another.

For the most part, known clapper-type percussion noisemakers have required specially shaped and formed arms, clapper elements, and other components that have no utility apart from devices of this kind. Some have been relatively simple and inexpensive but others, particularly those employing metal components, are rather costly to manufacture. Devices of this kind produce a single, distinctive sound; only the repetition frequency of that sound is determined by the user.

SUMMARY OF THE INVENTION

It is a principal object of the present invention to provide a new and improved percussion noisemaker of the clapper type that is capable of producing two distinct sounds.

Another object of the invention is to provide a new and improved percussion noisemaker of the clapper type that effectively amplifies the sounds produced.

A further object of the invention is to provide a new and improved percussion noisemaker of the clapper type that can be fabricated from components commonly used in other environments, so that the noisemaker is quite inexpensive to manufacture.

Accordingly, the invention relates to a dual-effect percussion noisemaker comprising a pair of flat, elongated clapper arms each having a handle end and a clapper end, and mounting means for mounting the handle ends of the clapper arms together with flat surfaces of the arms facing each other in an elongated, narrow V configuration in which the clapper ends of the arms are displaced from each other. A pair of clapper members are mounted on the clapper ends of the arms on the inner side of the V in spaced alignment opposite to each other, and a pair of hollow conical sounding members are mounted on the clapper ends of the arms on the outer sides of the V in alignment with the clapper members.

DESCRIPTION OF THE PREFERRED EMBODIMENT

Figure 1:
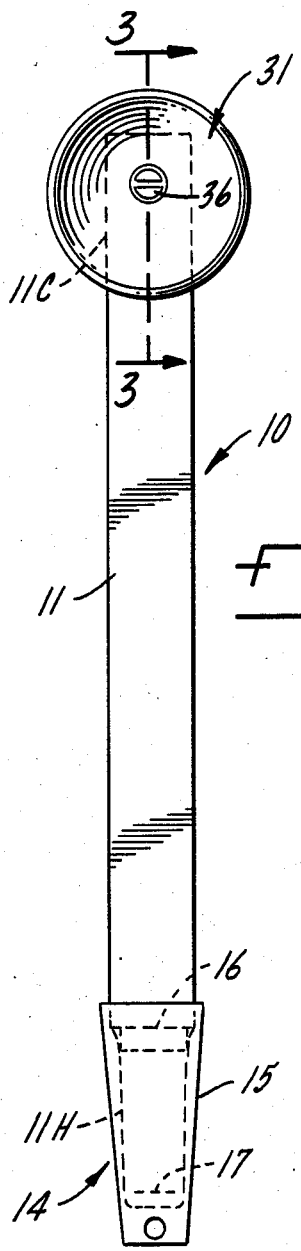
FIG. 1 is a front elevation view of a percussion noisemaker constructed in accordance with a preferred embodiment of the invention.

The drawings illustrate a percussion noisemaker 10 of the clapper type, constructed in accordance with a preferred embodiment of the invention. Noisemaker 10 includes a pair of flat, elongated clapper arms 11 and 12. Arm 11 has a lower handle end 11H and an upper clapper end 11C; similarly, arm 12 has a handle end 12H and a clapper end 12C. Arms 11 and 12 are each preferably formed as a simple thin wooden slat. Indeed, in the preferred construction each of the clapper arms 11 and 12 is a conventional wood paint-stirring paddle.

Noisemaker 10 includes a mounting means generally indicated at 14 for mounting the handle ends 11H and 12H of clapper arms 11 and 12 together with the flat surfaces of the arms facing each other. In the illustrated embodiment, this mounting means comprises a molded resin sheath 15 of relatively soft and flexible material, into which the handle ends 11H and 12H of arms 11 and 12 are inserted. Sheath 15, in the illustrated construction, constitutes the end of the handle from a commercially available ice scraper sold for use on automobile windshields and the like. Mounting means 14 may further include a staple or other fastener 17 holding the two handle ends 11H and 12H together prior to insertion in sheath 15. However, fastener 17 is not essential. A short wood dowel 16 is inserted between arms 11 and 12 just below the top of sheath 15 and is preferably glued in place. Dowel 16 affords a fulcrum member for operation of noisemaker 10 as described hereinafter.

Figure 2:
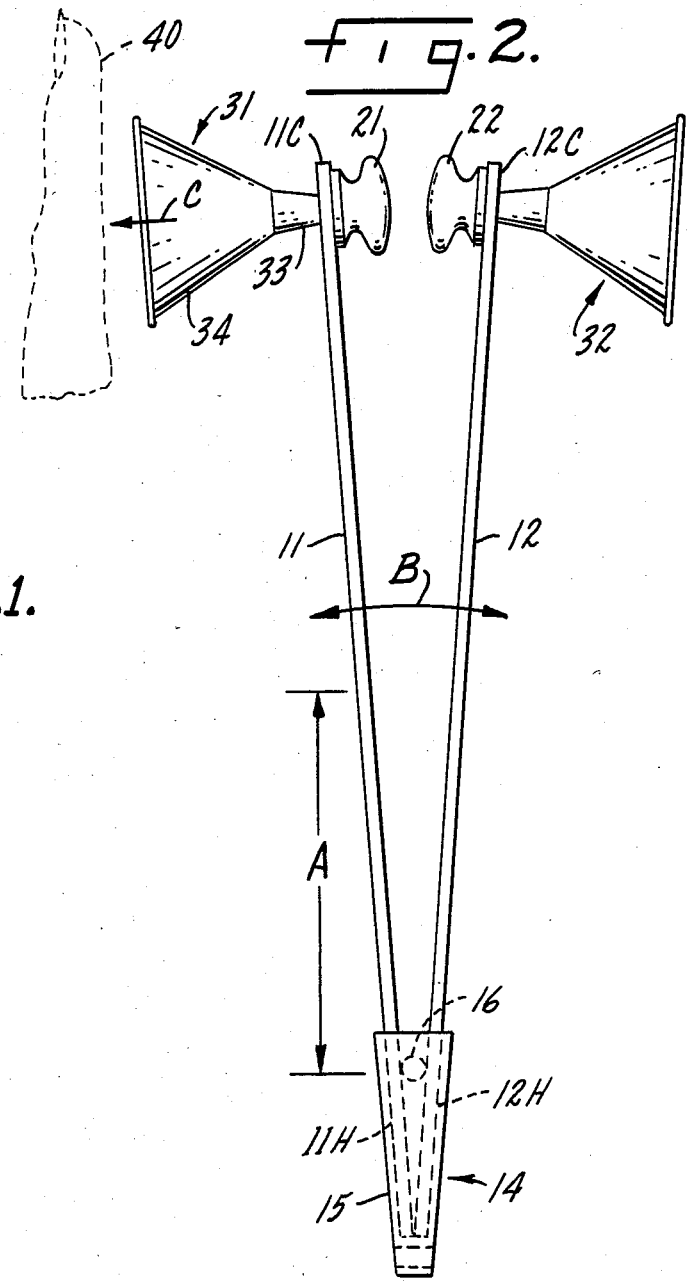
FIG. 2 is a side elevation view of the percussion noisemaker of FIG. 1.

When noisemaker 10 is assembled, clapper arms 11 and 12 form an elongated narrow V configuration with the clapper ends 11C and 12C displaced a short distance from each other, as best shown in FIG. 2. A first clapper member 21 is affixed to the clapper end 11C of arm 11 on the inner side of the V. A similar clapper member 22 is affixed to the clapper end 12C of arm 12 on the inner side of the V; clapper member 22 is aligned directly opposite clapper member 21. With noisemaker 10 in the relaxed state illustrated in FIG. 2, the two clapper members 21 and 22 remain slightly spaced from each other; typically, the spacing may be about one-fourth to one inch. Each of the clapper members 21 and 22 is preferably formed of wood for two purposes, first to minimize cost and second to obtain the best possible sound from noisemaker 10. In the preferred construction, clapper members 21 and 22 are simple, inexpensive wooden knobs used conventionally as drawer pulls.

Noisemaker 10 further comprises a pair of hollow conical sounding members 31 and 32 mounted on the clapper ends of arms 11 and 12 on the outer sides of the V (FIG. 2) in alignment with clapper members 21 and 22, respectively. Sounding members 31 and 32 could be special molded or otherwise formed components utilized only for the noisemaker. Preferably, however, each of the sounding members comprises an inexpensive funnel of relatively stiff molded resin, made and sold for kitchen use and other similar uses. A two-ounce plastic funnel is quite satisfactory.

Figure 3:
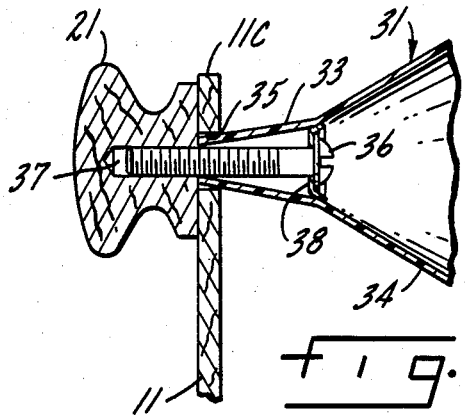
FIG. 3 is a detail sectional view, on an enlarged scale, taken approximately as indicated by line 3—3 in FIG. 1.

The preferred mounting of the funnel sounding member 31 on clapper end 11C of arm 11 is illustrated in FIG. 3. As shown therein, sounding member 31 has a slightly tapered stem 33 that merges into an outer funnel cone 34. A hole 35 is drilled through the clapper end 11C of arm 11 and clapper member 21 is glued to arm 11 in approximately centered relation to hole 35. Hole 35 is preferably just large enough to allow for insertion of stem 33 of sounding member 34 through the hole. A screw 36 extends through the stem 33 of sounding member 31 and is threaded into an axial opening 37 in clapper member 21. The head of screw 36 may be large enough to assure firm mounting of sounding member 31. Alternatively, one or more washers 38 may be utilized for this purpose.

The uses of noisemaker 10 are quite simple. In one mode of use, the arms 11, 12 of noisemaker 10 may be grasped in one hand, preferably in the area A identified in FIG. 2 and then waved rapidly back and forth as indicated by arrows B. Arms 11 and 12 bend and clapper members 21 and 22 bang together. This produces a repetitive noise consisting of a sequence of clapping sounds, the tone and timbre of the sounds being determined by the wood clapper members 21 and 22. The sound is effectively amplified by the sounding members 31,32; the sounding members also modify the tone and timbre, making the sound deeper and more resonant. The frequency of this clapping sound is determined, of course, by the user. A similar but slower sound can be obtained by alternately squeezing and releasing arms 11 and 12 to bang clapper members 21 and 22 together.

In a second technique for using noisemaker 10, arms 11 and 12 are again grasped in one hand, in the region A or lower. One of the sounding members 31,32 is then banged against the other hand of the user (see phantom outline 40 and arrow C), again producing a loud percussion noise. The tone and timbre, however, are distinctively different from the sound produced with the previously described techniques.

The previously described techniques for use of noisemaker 10 can also be employed simultaneously, with the user grasping the noisemaker with one hand in the region A, waving it back and forth rapidly to produce a first noise, and making intermittent contact with the user's other hand 40 to produce a second sound. The two percussion clapping noises, in combination, are quite startling.

Although clapper members 21 and 22 may be formed of plastic or other material, the best sounds are produced from noisemaker 10 when these clapper members made of of wood. The funnel sounding members 31 and 32 greatly increase the volume of sound output from the noisemaker and improve its tonal qualities. All of the individual parts of noisemaker 10 are readily available as commercial products intended for other uses, so that the overall cost of the noisemaker is quite low.

What is claimed is:

1. A dual-effect percussion noisemaker comprising:

a pair of elongated, bendable clapper arms each having a handle end and a clapper end;

mounting means for mounting the handle ends of the clapper arms together in an elongated, narrow V configuration in which the clapper ends of the arms are displaced from each other;

a pair of clapper members mounted on the clapper alignment opposite to each other; and ends of the arms on the inner side of the V in spaced a pair of hollow conical sounding members mounted on the clapper ends of the arms on the outer sides of the V in alignment with the clapper members to amplify and modify sounds produced by banging the clapper members together.

2. A percussion noisemaker according to claim 1 in which the clapper members are thin, flat wood slats having flat surfaces facing each other on the inner side of the V.

3. A percussion noisemaker according to claim 1 in which the mounting means comprises a soft, flexible molded resin sheath encompassing the handle ends of the clapper arms.

4. A percussion noisemaker according to claim 3 and further comprising a fulcrum member mounted intermediate the clapper arms adjacent their handle ends.

5. A percussion noisemaker according to claim 4 in which the clapper members are wood knobs.

6. A percussion noisemaker according to claim 1 in which the sounding members are molded resin funnels.

7. A percussion noisemaker according to claim 6 in which the clapper members are wood knobs and each sounding member includes a stem that extends through one clapper arm and is anchored to the clapper member on that arm.

8. A percussion noisemaker according to claim 7 in which the clapper arms are thin, flat wood slats.

9. A percussion noisemaker according to claim 1 in which:

the clapper arms are thin, flat wood slats;

the mounting means comprises a molded resin sheath encompassing the handle ends of the clapper arms;

a fulcrum member is mounted intermediate the clapper arms adjacent their handle ends;

the clapper members are wood knobs; and the sounding members are molded resin funnels.

* * * * *